United States Patent [19]

Raines et al.

[11] 4,096,652

[45] Jun. 27, 1978

[54] RETRACTABLE SNOWPLOW WING AND MOUNTING THEREFOR

[75] Inventors: William L. Raines; John Karges, Jr., both of Sherman, N.Y.

[73] Assignee: H. K. Nuttall Equipment Co., Inc., Sherman, N.Y.

[21] Appl. No.: 739,940

[22] Filed: Nov. 8, 1976

[51] Int. Cl.[2] ..... E01H 5/00

[52] U.S. Cl. ..... 37/41; 37/42 VL; 37/105

[58] Field of Search ..... 37/41, 42 R, 42 VL, 37/44, 46, 50, 105; 172/801-809

[56] References Cited

U.S. PATENT DOCUMENTS

| | | | |
|---|---|---|---|
| 1,547,018 | 7/1925 | Bressler | 37/105 |
| 1,742,327 | 1/1930 | Tellis | 37/105 |
| 1,742,328 | 1/1930 | Tellis | 37/105 |
| 1,763,680 | 6/1930 | Tellis | 37/105 |
| 1,838,730 | 12/1931 | Banton | 37/105 |
| 1,880,984 | 10/1932 | Remington | 37/42 R |
| 2,101,666 | 12/1937 | Austin | 37/105 X |
| 2,144,698 | 1/1939 | Allan | 37/44 |
| 2,491,797 | 12/1949 | Burns et al. | 37/105 |
| 2,524,329 | 10/1950 | Richardson | 37/44 |
| 3,659,363 | 5/1972 | Snyder | 37/42 R |

FOREIGN PATENT DOCUMENTS

| | | | |
|---|---|---|---|
| 606,485 | 10/1960 | Canada | 37/50 |
| 324,382 | 10/1957 | Switzerland | 37/42 R |

*Primary Examiner*—E. H. Eickholt
*Attorney, Agent, or Firm*—Ashlan F. Harlan, Jr.

[57] ABSTRACT

A retractable snowplow wing and mounting therefor which can be installed on substantially any truck with a longitudinal frame. The wing which may basically be of any desired construction is supported at both its inboard and outboard ends to permit raising it and swinging it horizontally from plowing position to a position substantially parallel to the truck body. The mechanism comprises first means attached to the inboard end of the wing and slidably mounted for vertical movement on support means carried by the truck frame and second means attached to the outboard end of the wing and comprising an extensible strut and motor means both of which are pivotally mounted on a bracket secured to the truck frame and extending laterally therefrom. Said first means comprises a hanger mounted for horizontal pivotal movement on a vertically movable slide carried on said support means; and said motor means, which comprises a hydraulic cylinder, is slidably connected at its outer end with said strut and is pivotally mounted at its other end on said bracket whereby to raise and retract the outboard end of said wing. Said bracket is rigidly secured, as by welding, to said truck frame and depends therefrom with a member laterally removed from said frame supporting said strut and motor means. The wing is pivotally carried on said hanger to permit limited horizontal pivoting movement thereof against the resistance of a spring to allow the blade of said wing to pass over minor obstructions or irregularities in the pavement; and detent means is provided to selectively prevent such pivoting movement. A wing, according to the invention, can be mounted on either side of a truck or wings can be mounted on both sides.

16 Claims, 10 Drawing Figures

RETRACTABLE SNOWPLOW WING AND MOUNTING THEREFOR

BACKGROUND OF THE INVENTION

The invention of the present application relates to snow-removing apparatus and particularly to the type of such equipment known as snowplow wings. Such wings are ordinarily used as supplements to a snowplow and extend laterally beyond the latter. The main plow is usually mounted on the front of a truck or other wheeled vehicle, and the wing serves to provide a cleared path wider than that cleared by the main plow alone. One of the problems encountered with snowplow wings is that of mounting them on the truck body in such manner as to permit their easy removal and to provide for adjustment and raising to avoid obstacles. Another problem has been found in providing mounting means for snowplow wings which is adaptable for use on trucks with a variety of body constructions. A number of mounting arrangements have been suggested, but no completely satisfactory construction has hitherto been found.

SUMMARY OF THE INVENTION

The invention of the present application provides a retractable snowplow wing having a mounting that may be easily installed on any truck provided with a longitudinal frame, the mounting permitting the wing to be easily raised from an operative, plowing position in which the wing extends laterally from the truck at a trailing angle, also referred to as a sweep angle, thereto, and in contact with the ground or pavement, to an inoperative position in which the blade extends rearwardly, substantially parallel to the truck body, and is elevated above the pavement to clear obstacles. It also permits the easy removal of the wing from the truck when its use is not desired.

As hereinafter described, the snowplow wing of the present invention is supported at both its forward, inboard, end and its rear, outboard, end to permit pivotal movement so that it may be retracted from a plowing position to a retracted position substantially parallel with the truck body. At the same time, raising of the wing is permitted. This is accomplished by providing first means attached to the inboard end of the wing and slidably mounted for vertical movement on support means carried by the truck frame and second means attached to the outboard end of the wing and comprising an extensible strut and motor means both of which are pivotally mounted on a bracket secured to the truck frame and extending laterally therefrom. Said first means comprises a hanger mounted for horizontal pivotal movement on a vertically movable slide carried on said support means; and said motor means, which comprises a hydraulic cylinder, is slidably connected at its outer end with said strut and is pivotally mounted at its other end on said bracket whereby to raise and retract the outboard end of said wing. Said bracket is rigidly secured, as by welding, to said truck frame and depends therefrom with a member laterally removed from said frame supporting said strut and motor means. The wing is pivotally carried on said hanger to permit limited horizontal pivoting movement thereof against the resistance of a spring to allow the blade of said wing to pass over minor obstructions or irregularities in the pavement; and detent means is provided to selectively prevent such pivoting movement. A wing, according to the invention, can be mounted on either side of a truck or wings can be mounted on both sides.

SHORT DESCRIPTION OF THE DRAWINGS

DESCRIPTION OF THE INVENTION

Figure 1:
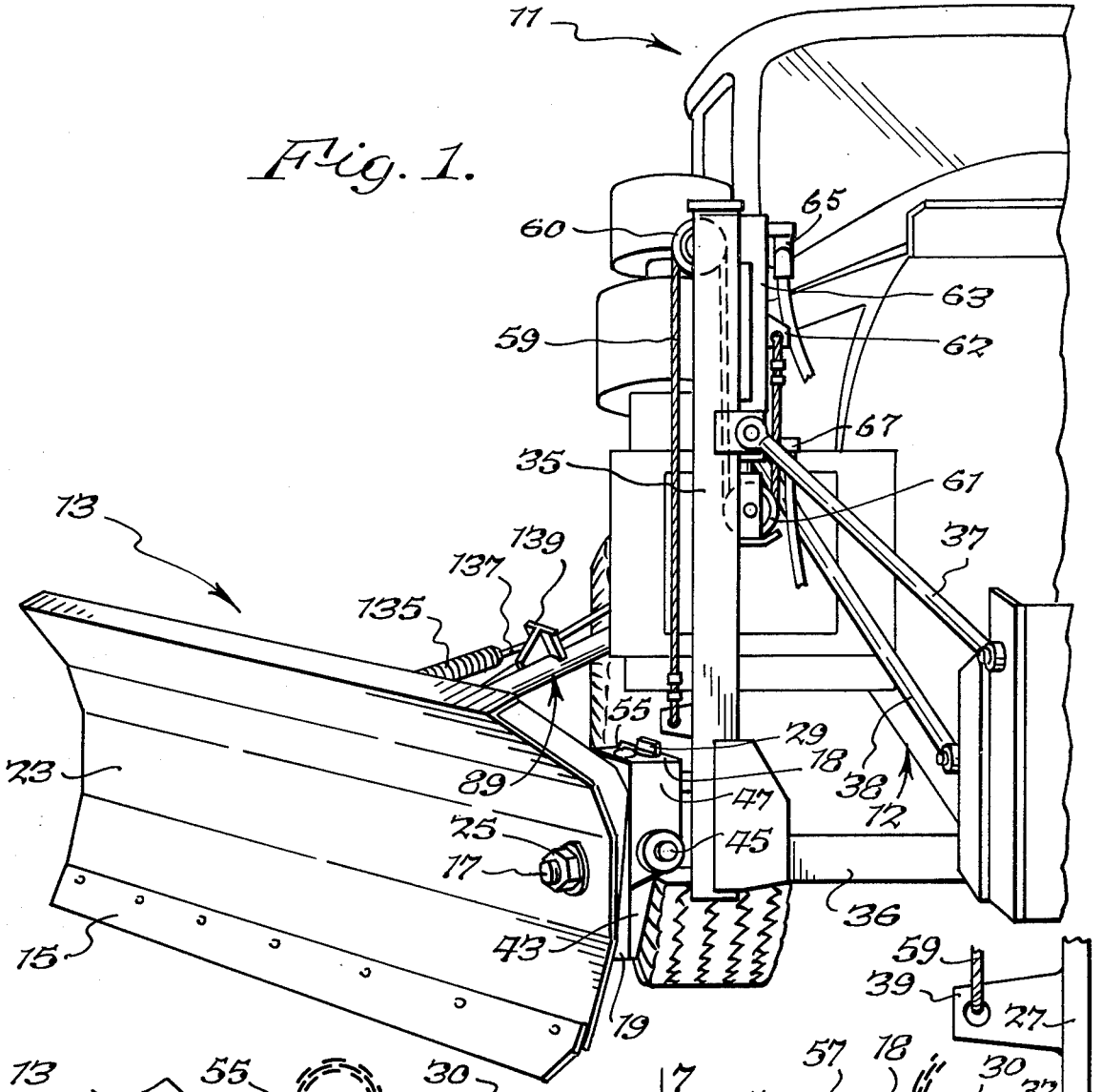
FIG. 1 is a front perspective of a retractable snowplow wing and mounting therefor, according to the present invention, shown installed in plowing position on a truck.
Figure 2:
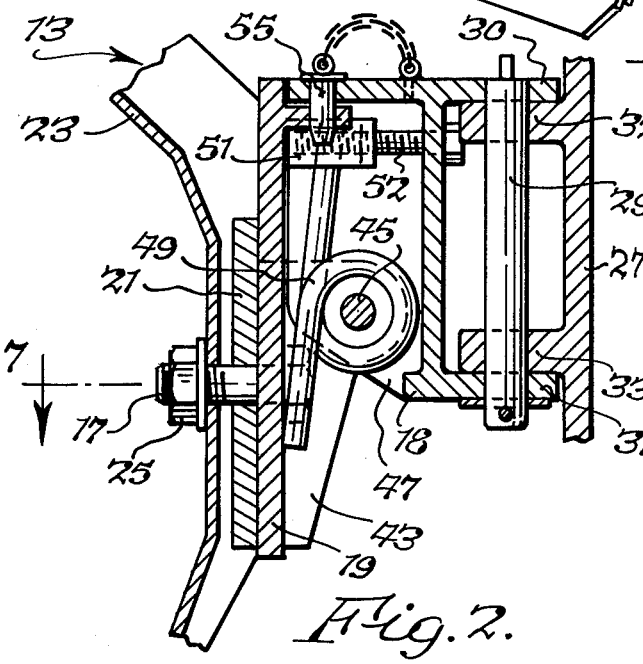
FIG. 2 is an enlarged, fragmentary vertical sectional view, showing details of the pivotal mounting for the front, inboard corner of the wing.
Figure 3:
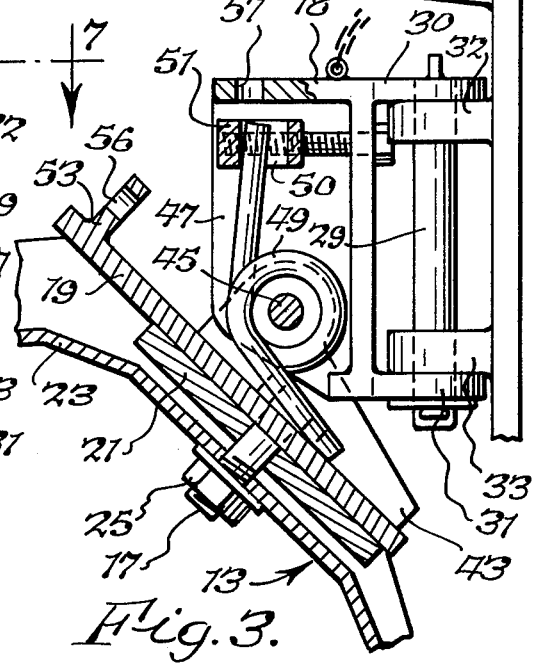
FIG. 3 is a detail view similar to FIG. 2, showing the wing in positon to ride over an irregularity or minor obstacle in the pavement surface.

The terms "upper", "lower", "top", "bottom", "right", "left", "above", "below", "vertical", and "horizontal", and similar terms of position and/or direction as used hereinafter refer to the illustrations in FIGS. 1–10, but are used only for convenience in description and/or reference. Such terms should not be so construed as to imply a necessary positioning of the structure or of portions thereof or as to limit the scope of this invention.

In the drawings the numeral 11 is used to denote a truck having a frame 12 upon which the novel snowplow wing of the present invention and its mounting are installed for use. The truck, itself, forms no part of the invention and substantially any truck having a longitudinal frame can be equipped with a novel wing construction according to the invention. As previously stated, the wing, itself, which is comprehensively designated 13, when in use extends laterally from the truck 11 at a trailing angle thereto with the attached blade 15, preferably formed of alloy steel and secured by suitable means, such as riveting, along the bottom edge of the wing, in contact with the ground or pavement. The wing 13 is supported adjacent both its forward, inboard end and its trailing, outboard end and is adapted, when not in use, to be elevated and swung back substantially parallel with the truck 11, by means hereinafter described. The details of the wing structure aside from the mounting mechanism are not critical and any suitable design and/or construction can be used therefor.

At its forward end, the wing 13 is secured by a bolt 17 to a hanger 18. The bolt 17 passes through a depending pivoted plate 19 of the hanger, through a plate or bar 21 and through the mold board 23 of the wing, being secured by a nut 25. The hanger 18 is pivotally mounted for horizontal movement on a vertically reciprocatable slide 27 by a king pin 29, that passes through rearwardly extending, vertically spaced ears 30 and 31 on the hanger and vertically spaced lugs 32 and 33 that extend outwardly from the slide 27 between the ears 30, 31. The slide 27 is mounted in oppositely disposed, vertically extending grooves 28 provided in a vertical wing post 35 that is secured to the frame 12 of the truck 11 adjacent the right front corner thereof by a supporting girder 36 and braced by struts 37 and 38. The slide 27 is provided with a projecting ear 39 and may be raised or lowered in the grooves 28, by means hereinafter described attached to said ear, to raise or lower the wing 13.

As previously indicated, the plate 19 of the hanger 18 is pivoted to the latter. This is most clearly shown in FIGS. 2, 3, 7 and 8. Spaced lugs or flanges 43 extending rearwardly from the plate 19 are provided with horizontal holes through which there extends a horizontal shaft or pivot pin 45 that passes through side flanges 47 on the hanger 18, thus permitting vertical tilting of the plate. The shaft 45 is encircled by a coil spring 49 having ends extending in opposite directions. The lower end of the spring 49 bears against the rear side of plate 19 and the other end is held in a vertical hole 50 provided in an oblong nut 51 that is adjustably positionable on a threaded stud 52 held in the body of the hanger 18. The force exerted by the spring 49 can thus be adjusted by relative rotation of the nut 51 and the stud 52.

Figure 4:
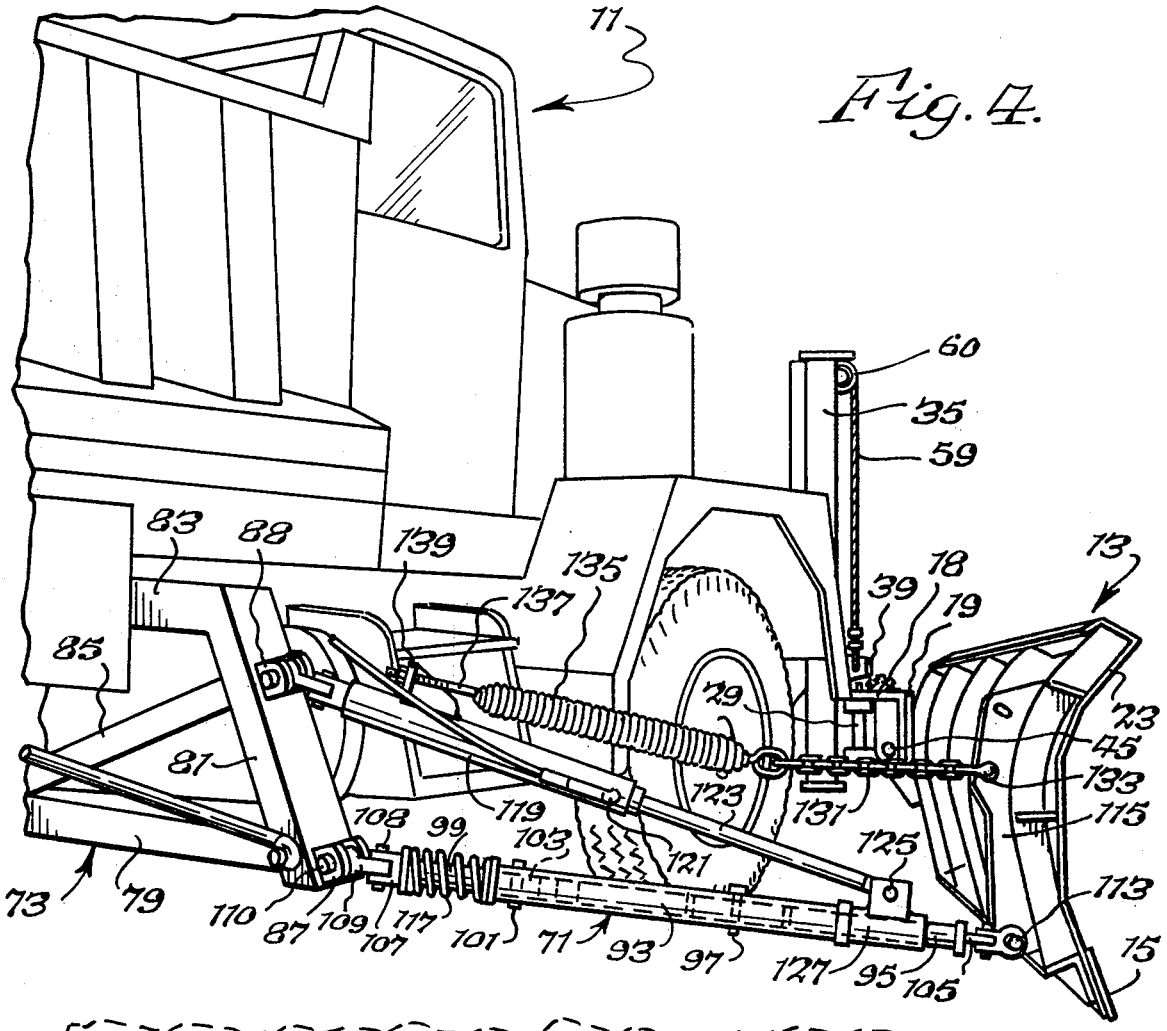
FIG. 4 is a perspective view side view of the wing illustrated in FIG. 1, showing details of the means for extending, retracting and elevating the trailing, outboard end of the wing.
Figure 5:
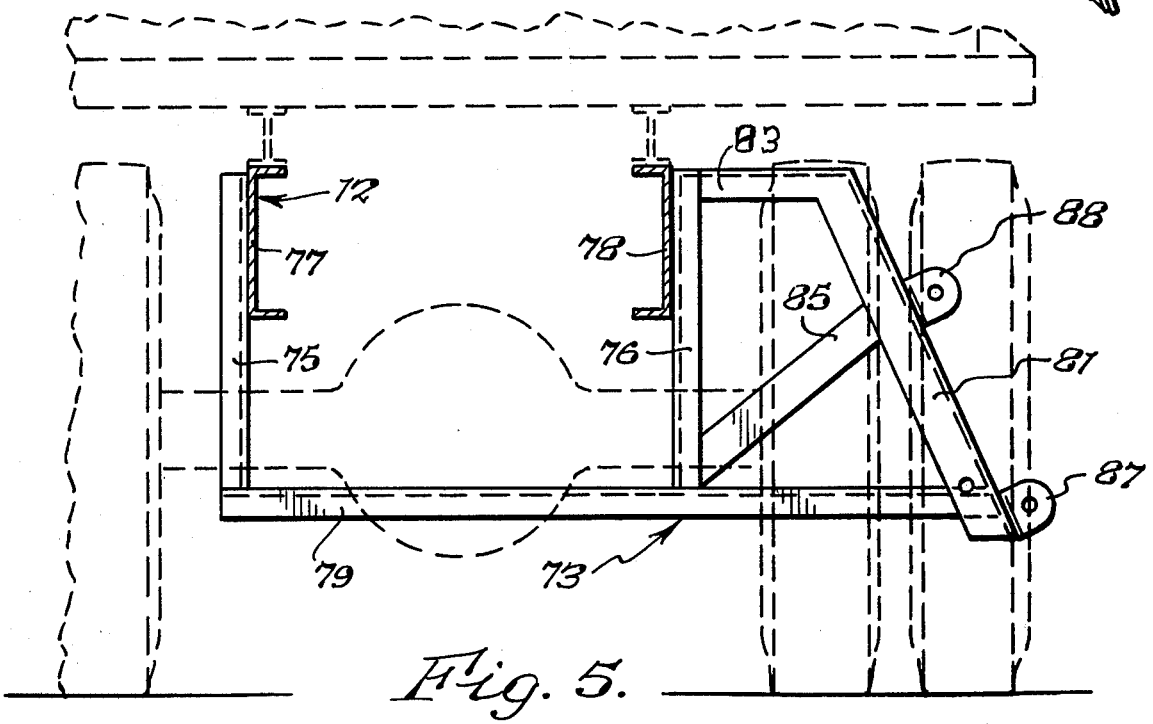
FIG. 5 is an enlarged cross sectional view looking forward from the rear of the truck and showing a bracket for mounting the trailing end of the wing on the truck frame.

In its normal operating position, as illustrated in FIGS. 1 and 4, the wing 13 has an upright position. It is desirable, however, to provide for occasions when the blade 15 strikes an object, such e.g. as a manhole cover, which could damage the wing structure or its supports. This is provided by the shaft 45 and coil spring 49. The lower end of the spring 49 engages the hanger plate 19 at a point below the shaft 45 and thus tends to maintain the wing 13 upright. However, force applied to the lower edge of the wing from its front side by encounter with an obstacle will cause the wing and the plate 19 attached thereto to pivot about the shaft 45, thus relieving the stress and permitting the blade 15 to pass over the obstacle. Afterwards, the wing 13 will be returned to its normal position by the spring. A latch or detent is provided to prevent pivoting of the wing when this is desired. The latch comprises a rearwardly projecting, apertured lug 53 on the rear face of the plate 19, adjacent the upper edge thereof, and a removable pin 55 that passes through a hole 57 in the top face of the hanger 18 and through the aperture 56 in the lug 53. Removal of the pin 55 permits the wing 13 to pivot on the shaft 45.

The forward end of the wing 13 may be raised from the position illustrated in FIGS. 1 and 4 by raising the slide 17 in the grooves 28 of the wing post 35. This is accomplished, as shown, with a flexible cable 59, which at one end is secured to the ear 39 on the slide 27. The cable 59 passes around a fixed pulley 60 secured to the wing post 35 adjacent the upper end of the latter, and, after passing around a vertically movable sheave 61, is secured at its other end to an ear 62 attached to a hydraulic cylinder 63 fixedly mounted on the wing post 35 adjacent the top thereof. The movable sheave 61 is carried on the end of the depending piston rod 64 of the hydraulic cylinder 63. Thus, when pressure fluid is admitted to the cylinder 63, through the connection 65, above the piston (not shown), the piston rod 64 and the sheave 61 move downwardly and the hanger 18, with the forward end of the wing 13, is raised. When the movement of the piston (not shown) in the cylinder 63 is reversed by supplying hydraulic fluid to the latter through the connection 67 on the cylinder below the piston, the piston rod 64 and sheave 61 move upwardly, and the wing 13 is lowered.

At its rear, outboard, end the wing 13 is attached to a strut 71 that is pivotally carried by a push frame or bracket designated comprehensively as 73. The push frame 73, best shown in FIG. 5 and preferably formed by welding together the several members forming it, is located on the truck 11 approximately opposite the rear end of the wing 13 when the latter is positioned substantially parallel to the truck. The bracket 73 comprises a pair of spaced, parallel, vertical bars or girders 75 and 76 which depend, respectively, from the opposing longitudinal frame members 77 and 78 of the truck frame 12, to which they are preferably secured by welding. The lower ends of the bars 75 and 76 are connected by a horizontal girder or plate 79 that projects laterally beyond the bar 76 and is attached to a plate 81 that is inwardly and upwardly inclined. At its upper end the plate 81 is attached to a short horizontal plate 83 attached to the bar 76; and it is further attached to the bar 76 by a diagonal brace 85 extending from the bar to the plate at a point substantially midway of the latter. Spaced pairs, 87 and 88, of perforated ears that extend outwardly toward the side of the truck 11 are attached to the plate 81 at its lower end and opposite the brace 85, respectively, for attachment of the strut 71 and motor means 89 therefor.

Figure 6:
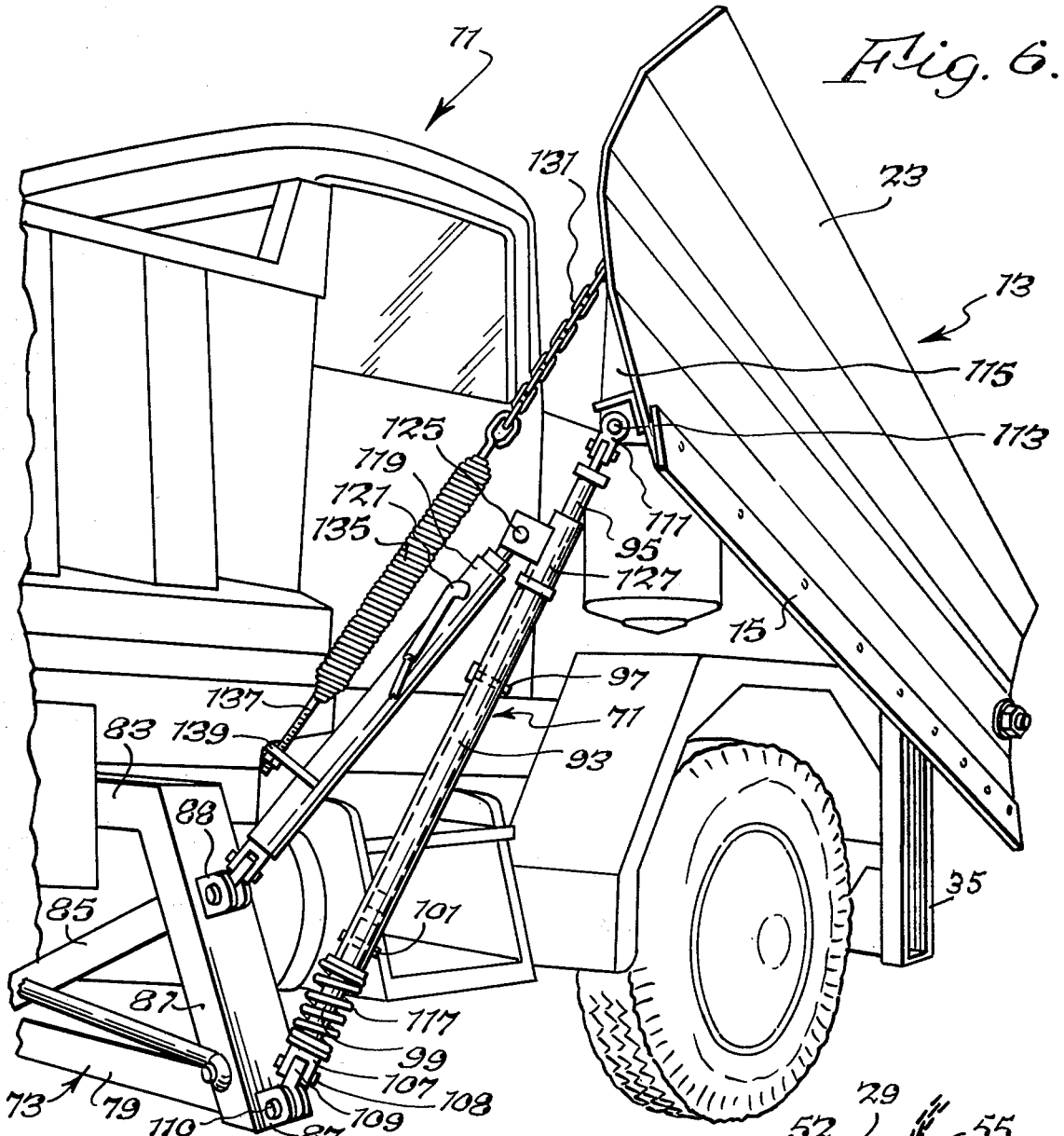
FIG. 6 is a perspective side view similar to FIG. 4 with the wing in retracted and elevated position.
Figure 7:
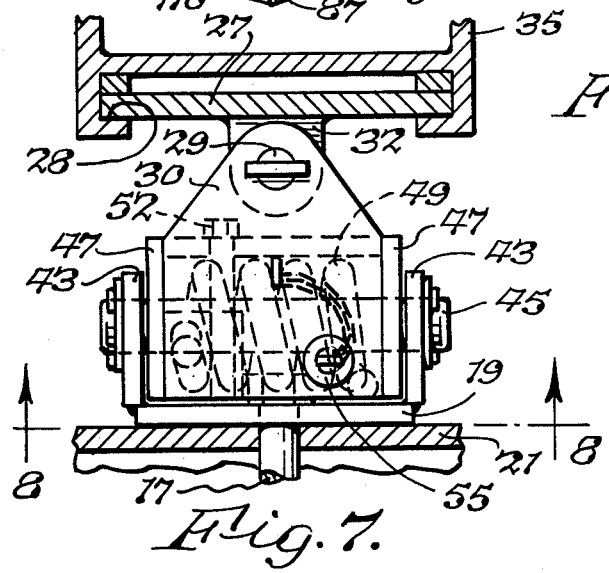
FIG. 7 is a horizontal sectional view, taken along the line 7—7 of FIG. 2, showing further details of the mechanism for supporting the forward end of the wing.
Figure 8:
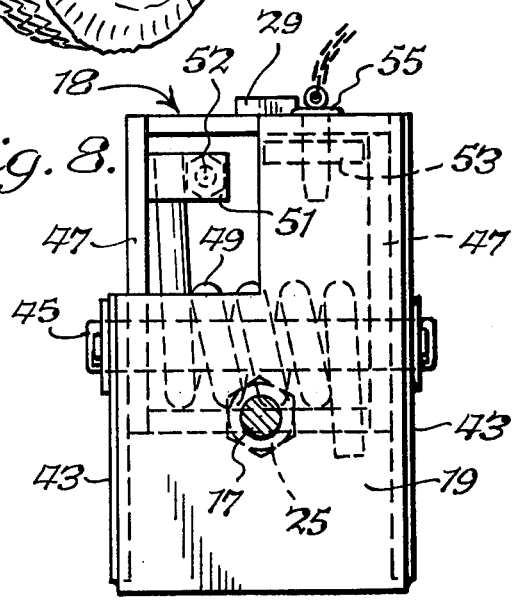
FIG. 8 is a vertical sectional view, taken along the line 8—8 of FIG. 7.
Figures 9, 10:
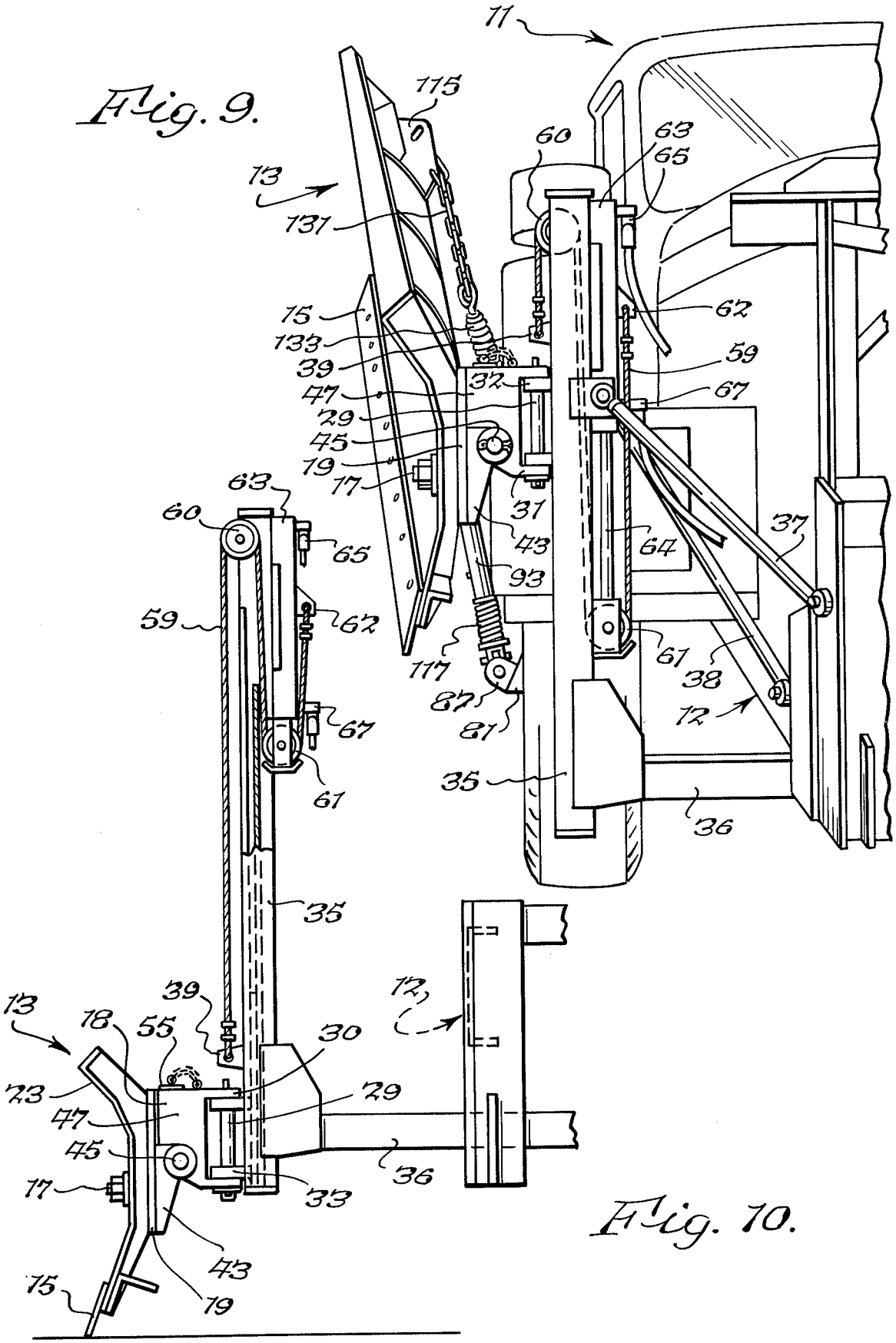
FIG. 9 is a front perspective, similar to FIG. 1, showing the wing retracted and elevated.
FIG. 10 is a vertical, fragmentary front view, showing details of the means provided for elevating the forward end of the wing.

The strut 71 serves not only to hold the rear or trailing end of the wing 13 at a desired lateral distance from the truck when the wing is in operation, but serves also, as hereinafter described, to retract the wing and assist to raise it to the position shown in FIGS. 6 and 9. The strut 71 comprises a tube 93 in one end of which there is inserted a rod 95 suitably held in place, as by a pin 97. In the other end of the tube 93 there is inserted a rod 99 that is held in the tube and permitted limited reciprocating motion therein by a pin 101. The latter is secured in a hole in the tube and passes through a longitudinal slot 103 in the rod 99. The outer end of the rod 95 is provided with an eye 105 and the outer end of the rod 99 is provided with longitudinally extending, spaced, perforated ears 107. The latter are connected by a pin 108 to one end of a swivel link 109, the other end of which is held between the ears 87 on the plate 81 by a pin 110. The eye 105 on the rod 95 is connected to one end of a swivel link 111 by the pin 112, the other end of the link 111 being pivotally secured by a pin 112 on a bracket flange 115 suitably secured to the rear face of the wing 13 adjacent the outboard end thereof. A coiled compression spring 117 is provided around the rod 99 between the tube 93 and the ears 107. Thus, the pin 101 is normally positioned at the outer end of the slot 103 in the tube 93.

The motor means 89 comprises a hydraulic cylinder 119 having a connection 121 to a source (not shown) of pressure fluid and a piston rod 123 projecting laterally outward from the bracket 73. The cylinder 119 is mounted for swiveling movement on the ears 88 provided on the plate 81, the mounting preferably being substantially similar to that for the strut 71. The free end of the piston rod 123 is pivotally secured by a pin 125 to a slide 127 that is mounted for free movement on the rod 95 of the strut 71 outwardly of the tube 93. The slide thus has a lost motion connection to the strut 71 which permits the wing to move against the resilient resistance of the spring 117. It will be evident that when pressure fluid is supplied to the cylinder 119 on the outer side of the piston (not shown), the piston rod 123 will be retracted and exert an upward, lifting force on the rod 95, thereby lifting the outboard end of the wing 13 and swinging it on the king pin 29.

A safety chain 131 is provided to stabilize the trailing or outboard end of the wing 13. One end of the chain 131 is suitably attached, for example, by a shackle 133, to the flange 115 above the point at which the swivel link 111 is attached. The other end of the chain 131 is suitably attached to one end of a heavy tension spring 135, which, at its opposite end, is carried by a rod 137 held in a bracket 139 securely mounted on the cylinder 119. The spring 135 serves to restrain the wing from tilting excessively when the locking pin 55 on the hanger 18 is withdrawn.

The operation of the novel snowplow wing and mounting of the present invention will be apparent from the foregoing description. It will also be clear that this apparatus can be mounted on substantially any truck; that it does not take up space on the upper portion of the truck which could be used for payload; that it is easy to assemble, install, operate, and remove; and that it is rugged and durable. Obviously, according to the invention a wing can be mounted on either side of a truck or wings can be mounted on both sides.

It will be understood that numerous variations from and modifications of the above-described embodiment may be made without departing from the spirit of the invention. Also, of course, it will be understood that good manufacturing practices will provide suitable washers, cotter pins, and other hardware items at the points necessary, although these are not specifically referred to herein.

We claim:

1. In a retractable snowplow wing: means for mounting said wing on a vehicle having a longitudinal frame comprising opposed longitudinal members, said mounting means comprising first means attached to the inboard end of said wing for supporting and raising said inboard end and second means, separate and distinct from said first means, attached to the outboard, trailing end of said wing for supporting and raising said outboard end, said first means comprising a member slidably mounted for vertical movement on support means carried by said frame, said second means comprising a strut and motor means both pivotally mounted on a rigid, non-movable bracket that is secured to both longitudinal members of said frame and extends laterally therefrom, said strut constituting the sole support for the outboard end of said wing and being pivotally connected to said wing adjacent the bottom of said wing, and said motor means being operatively connected to and slidable on said strut adjacent its outer end for producing motion of said strut whereby to raise and move horizontally said outboard end of said wing.

2. A snowplow wing and mounting as defined in claim 1 wherein said first means comprises a hanger mounted for horizontal pivotal movement.

3. A snowplow wing and mounting as defined in claim 2 wherein said hanger is pivotally attached to said wing to permit pivotal movement of said wing about a horizontal axis.

4. A snowplow wing and mounting as defined in claim 3 wherein adjustable resilient means is provided on said hanger to resiliently restrain pivotal movement of said wing about a horizontal axis.

5. A snowplow wing and mounting as defined in claim 2 wherein said hanger is pivotally mounted on said vertically movable member.

6. A snowplow wing and mounting as defined in claim 1 wherein said strut is pivotally connected with said outboard end of said wing and is provided with means for resiliently resisting inward movement of said end.

7. A snowplow wing and mounting as defined in claim 1 wherein said motor means comprises a hydraulic cylinder pivotally mounted on said bracket and having a piston rod extending laterally outwardly from said bracket, said piston rod at its outer end being slidably mounted on said strut and adapted, when fluid pressure is imposed on the outer face of said piston, to retract and raise the outboard end of said wing.

8. A snowplow wing and mounting as defined in claim 5 wherein said vertically movable member is slidably carried by a vertical post member attached to said frame and is moved by second motor means.

9. A snowplow wing and mounting as defined in claim 8 wherein said post member is provided with a pulley adjacent the upper end thereof, wherein said second motor means comprises a hydraulic cylinder carried by said post member, said cylinder having a downwardly extending piston rod which carries a sheave, and wherein there is provided a cable secured at one end to said vertically movable member and at its other end to said post member adjacent the top thereof, said cable being trained around said pulley and said sheave whereby downward movement of said piston rod raises said vertically movable member and said wing.

10. In a retractable snowplow wing: means for mounting said wing on a vehicle having a longitudinal frame comprising opposed longitudinal members, said mounting means comprising first means attached to the inboard end of said wing for supporting and raising said inboard end, said first means comprising a hanger mounted for vertical movement and horizontal pivotal movement on support means carried by said frame, said hanger being pivotally attached to said wing to permit pivotal movement of said wing about a horizontal axis, and second means, separate and distinct from said first means, attached to the outboard, trailing end of said wing for supporting and raising said outboard end, said second means comprising a strut and motor means both pivotally mounted on a rigid bracket that is secured to said frame and extends laterally therefrom, said motor means being operatively connected to said strut adjacent its outer end for producing motion of said strut whereby to raise and move horizontally said outboard end of said wing, and a latch on said hanger to selectively prevent pivotal movement of said wing about said horizontal axis.

11. A snowplow wing and mounting as defined in claim 10 wherein said strut is pivotally connected with said outboard end of said wing and is provided with means for resiliently resisting inward movement of said end; and wherein said motor means comprises a hydraulic cylinder pivotally mounted on said bracket and having a piston rod extending laterally outwardly from said bracket, said piston rod at its outer end being slidably mounted on said strut and adapted, when fluid pressure is imposed on the outer face of said piston, to retract and raise the outboard end of said wing.

12. A snowplow wing and mounting as defined in claim 11 wherein said first means comprises a hanger pivotally mounted for horizontal pivotal movement on said vertically movable member, wherein said vertically movable member is slidably carried by a vertical post member attached to said frame and is moved by second motor means, and wherein said hanger is pivotally attached to said wing to permit pivotal movement of said wing about a horizontal axis.

13. In a retractable snowplow wing: means for mounting said wing on a vehicle having a longitudinal frame comprising opposed longitudinal members, said mounting means comprising first means attached to the inboard end of said wing for supporting and raising said inboard end and second means attached to the outboard, trailing end of said wing for supporting and raising said outboard end, said first means comprising a member slidably mounted for vertical movement on support means carried by said frame, said second means comprising a strut and motor means both pivotally mounted on a bracket that is secured to said frame and extends laterally therefrom, said bracket being rigid and comprising first members rigidly secured to and depending from the opposing longitudinal frame members and an upwardly and inwardly inclined second member projecting laterally of said frame members and carried by said first members, and said motor means being operatively connected to said strut for producing motion of the outer end of the latter whereby to raise and move horizontally said outboard end of said wing.

14. In a retractable snowplow wing: means for mounting said wing on a vehicle having a longitudinal frame comprising opposed longitudinal member, said mounting means comprising first means attached to the inboard end of said wing for supporting and raising said inboard end and second means attached to the outboard, trailing end of said wing for supporting and raising said outboard end, said first means comprising a member slidably mounted for vertical movement on support means carried by said frame, said second means comprising a strut and motor means both pivotally mounted on a bracket that is secured to said frame and extends laterally therefrom, said bracket being rigid and comprising a member, supported in part by a bar depending from one of said longitudinal frame members, to which said strut and said motor means are pivotally attached, one below the other, and said motor means being operatively connected to said strut for producing motion of the outer end of the latter whereby to raise and move horizontally said outboard end of said wing.

15. A snowplow wing and mounting as defined in claim 14 wherein said strut is pivotally connected with said outboard end of said wing and is provided with means for resiliently resisting toward movement of said end; and wherein said motor means comprises a hydraulic cylinder pivotally mounted on said bracket and having a piston rod extending laterally outwardly from said bracket, said piston rod at its outer end being slidably mounted on said strut and adapted, when fluid pressure is imposed on the outer face of said piston, to retract and raise the outboard end of said wing.

16. A snowplow wing and mounting as defined in claim 15 wherein said first means comprises a hanger pivotally mounted for horizontal pivotal movement on said vertically movable member, wherein said vertically movable member is slidably carried by a vertical post member attached to said frame and is moved by second motor means, and wherein said hanger is pivotally attached to said wing to permit pivotal movement of said wing about a horizontal axis.

* * * * *

UNITED STATES PATENT AND TRADEMARK OFFICE

CERTIFICATE OF CORRECTION

PATENT NO. : 4,096,652

DATED : June 27, 1978

INVENTOR(S) : William L. Raines, John Karges, Jr.

It is certified that error appears in the above-identified patent and that said Letters Patent are hereby corrected as shown below:

Claim 15, line 4, "toward" has been changed to -- inward --.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*